US011553569B2

(12) United States Patent
Kim et al.

(10) Patent No.: US 11,553,569 B2
(45) Date of Patent: Jan. 10, 2023

(54) LED DRIVING DEVICE AND LED DRIVING METHOD

(71) Applicant: SILICON WORKS CO., LTD., Daejeon (KR)

(72) Inventors: Ji Hwan Kim, Daejeon (KR); Kyeong Rok Lee, Daejeon (KR); Jong Hyun Yoon, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 17/408,079

(22) Filed: Aug. 20, 2021

(65) Prior Publication Data

US 2022/0070983 A1 Mar. 3, 2022

(30) Foreign Application Priority Data

Aug. 26, 2020 (KR) ..... 10-2020-0107669

(51) Int. Cl.
*G09G 3/32* (2016.01)
*H05B 45/325* (2020.01)
*H05B 45/44* (2020.01)

(52) U.S. Cl.
CPC ..... *H05B 45/325* (2020.01); *H05B 45/44* (2020.01)

(58) Field of Classification Search
CPC .. G09G 3/32; G09G 3/006; G09G 2310/0264; G09G 2310/0267; G09G 2310/0294; G09G 2320/0204; G09G 2320/064; H05B 45/10; H05B 45/325; H05B 45/44
See application file for complete search history.

(56) References Cited

U.S. PATENT DOCUMENTS

| | | | | |
|---|---|---|---|---|
| 7,385,575 | B2 * | 6/2008 | Seto | G09G 3/3216 345/82 |
| 8,289,263 | B2 * | 10/2012 | Lee | H05B 45/38 345/82 |
| 9,390,647 | B2 | 7/2016 | Li et al. | |
| 9,955,542 | B2 | 4/2018 | Li et al. | |
| 10,395,584 | B2 | 8/2019 | Nadershahi | |
| 10,720,098 | B2 | 7/2020 | Valentine | |
| 10,971,057 | B2 | 4/2021 | Jung et al. | |
| 2005/0052141 | A1 * | 3/2005 | Thielemans | G09G 3/3216 345/55 |
| 2022/0028310 | A1 * | 1/2022 | Kim | G09G 3/32 |

* cited by examiner

*Primary Examiner* — Thai Pham
(74) *Attorney, Agent, or Firm* — Fenwick & West LLP

(57) ABSTRACT

The present disclosure relates to an LED driving technique. The present disclosure provides a technique of measuring a time for reaching a forward voltage of a currently driven LED by comparing a forward voltage sensed in a previous scan line and an LED voltage sensed in a current scan line and for compensating for an ON period of a PWM (pulse width modulation) signal by the measured time for reaching the forward voltage.

15 Claims, 8 Drawing Sheets

LED DRIVING DEVICE AND LED DRIVING METHOD

CROSS REFERENCE TO RELATED APPLICATION

This application claims priority from Korean Patent Application No. 10-2020-0107669, filed on Aug. 26, 2020, which is hereby incorporated by reference for all purposes as if fully set forth herein.

BACKGROUND

1. Technical Field

Various embodiments generally relate to an LED driving technique.

2. Related Art

With the development of informatization, various display devices capable of visualizing information are being developed. A liquid crystal display (LCD), an organic light emitting diode (OLED) display device and a plasma display panel (PDP) display device are representative examples of display devices which have been developed so far or are being developed. These display devices are being developed to appropriately display high-resolution images.

However, the above-described display devices have advantages in terms of high resolution, but have disadvantages in that it is difficult to fabricate the display devices in large sizes. For example, since large OLED display devices developed so far have sizes of 80 inches (about 2 m) and 100 inches (about 2.5 m), they are not suitable for fabricating a large display device with a width of more than 10 m.

As a method for solving such a problem in terms of large size, interest in a light emitting diode (LED) display device is increasing recently. In an LED display device technique, as modularized LED pixels are disposed by a required number, one large panel may be configured. Otherwise, in an LED display device technique, as unit panels each of which is configured by a plurality of LED pixels are disposed by a required number, one large panel structure may be formed. As such, in the LED display device techniques, by disposing LED pixels by increasing the number thereof as many as required, a large display device may be easily realized.

The LED display device is advantageous in terms of not only large size but also various panel sizes. In the LED display device techniques, it is possible to variously adjust horizontal and vertical sizes according to appropriate disposition of LED pixels.

Meanwhile, an LED display device supplies driving current to an LED during an ON period of a PWM (pulse width modulation) signal. The ON period of the PWM signal is determined depending on a gray scale value of the LED. However, the LED does not emit light as soon as the driving current is supplied, and normal light emission is implemented only when a voltage across the LED reaches a forward voltage. Therefore, when the driving current is supplied during the ON period of the PWM signal, the actual brightness of the LED does not reach the gray scale value.

SUMMARY

Under such a background, in one aspect, the present disclosure is to provide a technique for more accurately controlling an ON period of a PWM signal so that the brightness of an LED can match a gray scale value. In another aspect, the present disclosure is to provide a technique for compensating a PWM signal for a forward voltage reaching time of an LED so that no loss in a gray scale value is caused. In still another aspect, the present disclosure is to provide a technique for simply measuring a forward voltage reaching time of an LED without using a separate sequence. In yet another aspect, the present disclosure is to provide a technique for accurately measuring a forward voltage reaching time of an LED, regardless of a change in characteristics of a panel, by continuously updating a forward voltage of the LED.

In one aspect, the present disclosure provides an LED driving device comprising: a driving current source configured to supply a driving current to a driving line to which a plurality of LEDs are connected; a driving control circuit configured to control a supply time of the driving current to the driving line according to a pulse width modulation (PWM) signal; a sample and hold circuit configured to sense a one-side voltage of an LED and to hold a voltage corresponding to a forward voltage; and a PWM compensating circuit configured to, during a time period in which one LED is connected to the driving line, measure a first time for a one-side voltage of the one LED to reach a voltage held regarding another LED and to compensate for the PWM signal according to the first time.

The one-side voltage may be an anode voltage of the LEDs, and cathodes of the LEDs may be connected to a ground voltage.

In another aspect, an embodiment may provide an LED driving device comprising: a driving current source configured to supply a driving current to a first LED during a first scan time and to supply the driving current to a second LED during a second scan time; a sample and hold circuit configured to, during the first scan time, sense a one-side voltage of the first LED and to hold a voltage corresponding to a forward voltage; and a compensating circuit configured to, during the second scan time, measure a first time for a one-side voltage of the second LED to reach the voltage held regarding the first LED and to control a supply time of the driving current to the second LED according to the first time.

In still another aspect, an embodiment may provide a method for driving a plurality of LEDs disposed in a panel including: connecting a first LED to one driving line according to a first scan signal; supplying a driving current to the first LED through the one driving line, and sensing and holding a forward voltage of the first LED; connecting a second LED to the one driving line according to a second scan signal; supplying the driving current to the second LED through the one driving line and measuring a first time for a one-side voltage of the second LED to reach the forward voltage of the first LED; and controlling a supply time of the driving current to the second LED according to the first time.

The method may further include: sensing and holding a forward voltage of the second LED when the driving current is supplied to the second LED through the one driving line; connecting a third LED to the one driving line according to a third scan signal; supplying the driving current to the third LED through the one driving line and measuring a second time for a one-side voltage of the third LED to reach the forward voltage of the second LED; and increasing a supply time of the driving current to the third LED according to the second time.

As is apparent from the above description, according to the embodiments, it is possible to more accurately control an ON period of a PWM signal so that the brightness of an LED can match a gray scale value. Also, according to the embodiments, it is possible to compensate a PWM signal for a forward voltage reaching time of an LED so that no loss in a gray scale value is caused. Further, according to the embodiments, it is possible to simply measure a forward voltage reaching time of an LED without using a separate sequence. Moreover, according to the embodiments, it is possible to accurately measure a forward voltage reaching time of an LED, regardless of a change in characteristics of a panel, by continuously updating a forward voltage of the LED.

DETAILED DESCRIPTION

Figure 1:
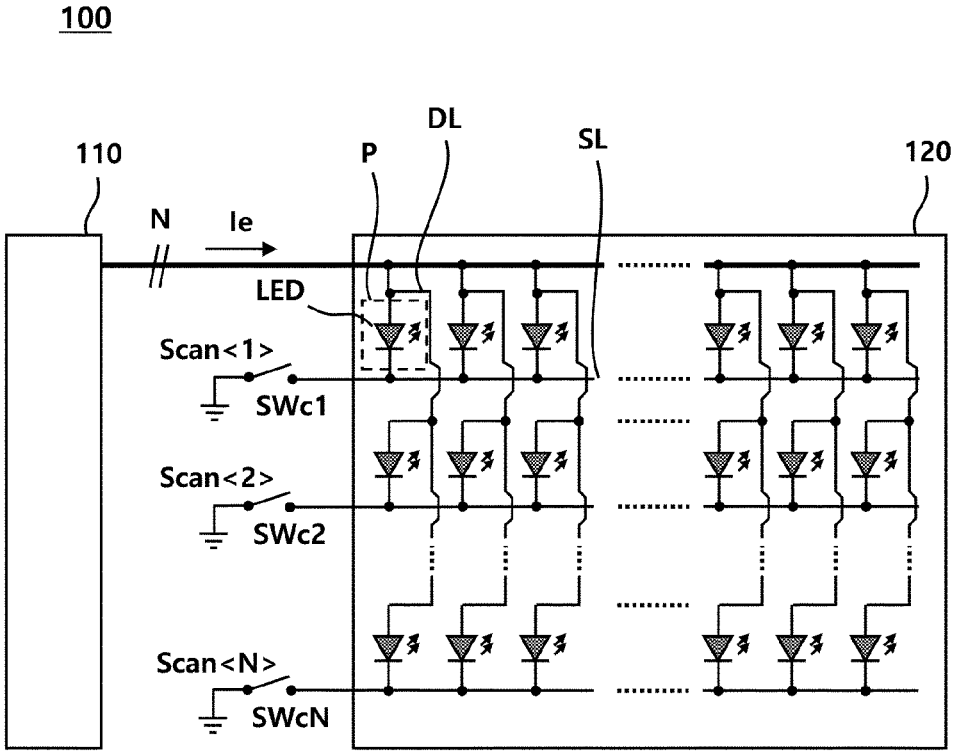
FIG. 1 is a configuration diagram of a display device in accordance with an embodiment.

FIG. 1 is a configuration diagram of a display device in accordance with an embodiment.

Referring to FIG. 1, a display device 100 may include a driving device 110 and a panel 120.

In the panel 120, a plurality of pixels P may be disposed while forming a matrix in a first direction (for example, a horizontal direction in FIG. 1) and a second direction (for example, a vertical direction in FIG. 1).

At least one LED (light emitting diode) may be disposed in each pixel P, and the brightness of the pixel P may be determined depending on the brightness of the LED.

Driving lines DL and scan lines SL may be disposed in the panel 120. Each driving line DL may connect one sides of pixels P in the second direction, and each scan line SL may connect the other sides of pixels P in the first direction. For example, an anode side of the LED disposed in the pixel P may be electrically connected to the driving line DL, and a cathode side of the LED may be electrically connected to the scan line SL. In the aspect that cathode sides of LEDs are connected in common, the structure illustrated in FIG. 1 is referred to as a common cathode structure, but it is to be noted that the present embodiment is not limited to such a structure.

Scan switches SWc1, SWc2, . . . and SWcN may be disposed in the scan lines SL, respectively, and a scan line SL to which driving current Ie is to be supplied may be determined depending on the opening and closing of the scan switches SWc1, SWc2, . . . and SWcN.

Figure 2:
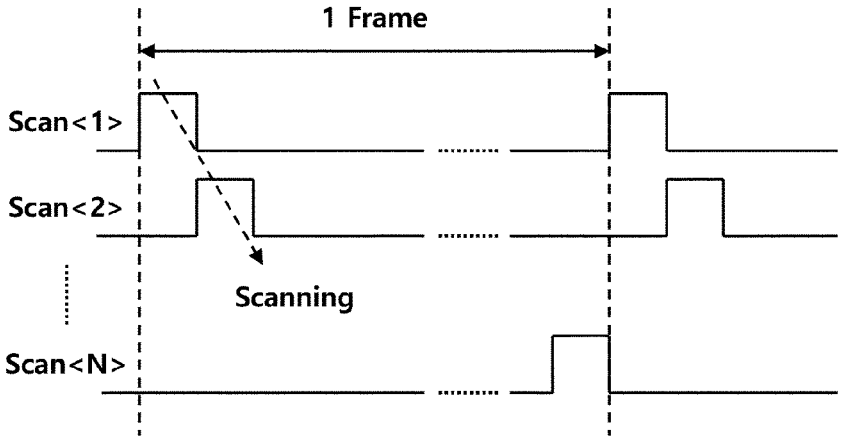
FIG. 2 is a diagram showing waveforms of scan signals in the display device in accordance with the embodiment.

FIG. 2 is a diagram showing waveforms of scan signals in the display device in accordance with the embodiment.

Referring to FIGS. 1 and 2 together, scan signals Scan<1>, Scan<2>, . . . and Scan<N> may be sequentially supplied to the scan switches SWc1, SWc2, . . . and SWcN, respectively, in each frame. The driving current Ie may be sequentially supplied to a first scan line SL, a second scan line SL, . . . and an N-th scan line SL depending on the scan signals Scan<1>, Scan<2>, . . . and Scan<N>.

The scan line SL may be connected to a low voltage part, such as the ground, in the display device 100. The scan switches SWc1, SWc2, . . . and SWcN may be formed in the panel 120 or a separate substrate. According to an embodiment, the scan switches SWc1, SWc2, . . . and SWcN may be formed in the driving device 110.

The scan signals Scan<1>, Scan<2>, . . . and Scan<N> may be supplied by the driving device 110 or may be supplied by a separate control device.

The brightness of the LED disposed in each pixel P may be determined depending on an amount of driving power supplied within a predetermined time. The LED may be PWM (pulse width modulation)-driven, and the brightness of the LED may be determined depending on a rate of a turn-on time within a PWM control time. When the LED is turned on by the driving current Ie, a forward voltage may be formed in the LED. An amount of driving power supplied to the LED may be obtained by accumulating the product of the forward voltage and the driving current Ie for the turn-on time within the PWM control time, and the brightness of the LED may be determined depending on the amount of driving power. Assuming that the forward voltage of the LED and a magnitude of the driving current Ie are fixed variables, the amount of driving power may be regarded as having a value that is proportional to the turn-on time within the PWM control time. According to this principle, the driving device 110 may control the brightness of the LED and the brightness of the pixel P by controlling the turn-on time within the PWM control time.

The driving device 110 may include a plurality of channels N which are connected to driving lines DL, and may supply the driving current Ie to each pixel P in each channel.

Meanwhile, an LED display device supplies driving current to an LED during an ON period of a PWM (pulse width modulation) signal. The ON period of the PWM signal is determined depending on a gray scale value of the LED. However, the LED does not emit light as soon as the driving current is supplied, and normal light emission is implemented only when a voltage across the LED reaches a forward voltage. Therefore, when the driving current is supplied during the ON period of the PWM signal, the actual brightness of the LED does not reach the gray scale value.

In order to solve such a problem, an embodiment provides a technique for compensating a PWM signal for a forward voltage reaching time of an LED so that the brightness of the LED can match a gray scale value.

Figure 3:
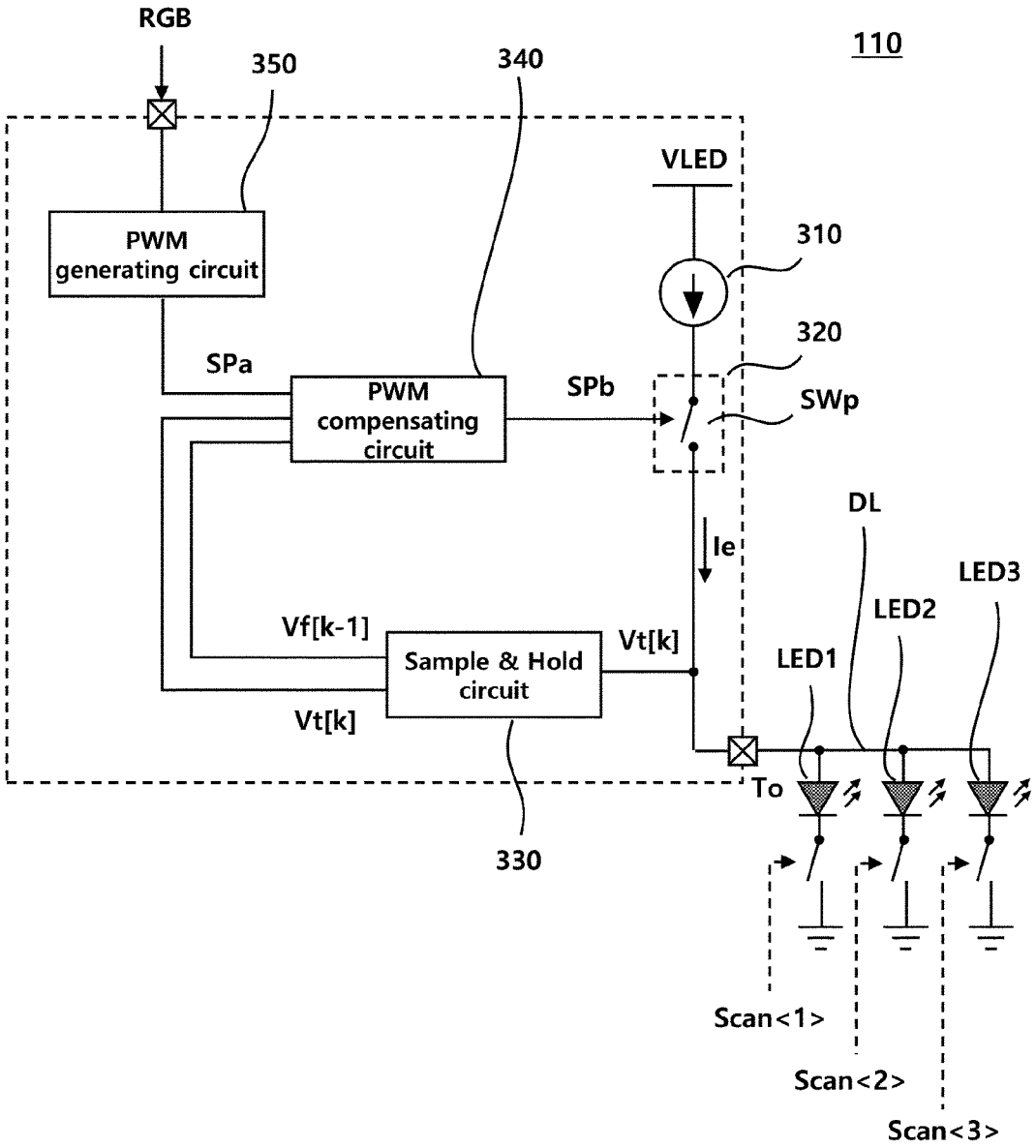
FIG. 3 is a configuration diagram of an LED driving device in accordance with an embodiment.

FIG. 3 is a configuration diagram of an LED driving device in accordance with an embodiment.

Referring to FIG. 3, the LED driving device 110 (hereinafter, referred to as a driving device) may include a driving current source 310, a driving control circuit 320, a sample and hold circuit 330, a PWM compensating circuit 340 and a PWM generating circuit 350.

The driving current source 310 may supply the driving current Ie to the driving line DL to which a plurality of LEDs LED1 to LED3 are connected. The driving current Ie may be supplied to one LED which is connected to the driving line DL among the plurality of LEDs LED1 to LED3.

One LED to which the driving current Ie is to be supplied may be determined by scan signals Scan<1> to Scan<3>. For example, when a first scan signal Scan<1> is supplied, a first LED LED1 may be connected to the driving line DL and the driving current Ie may be supplied to the first LED LED1, and when a second scan signal Scan<2> is supplied, a second LED LED2 may be connected to the driving line DL and the driving current Ie may be supplied to the second LED LED2.

The driving control circuit 320 may control a supply time of the driving current Ie to the driving line DL. As an example, the driving control circuit 320 may control the connection between the driving current source 310 and the driving line DL. When the driving control circuit 320 connects the driving current source 310 and the driving line DL, the driving current Ie generated by the driving current source 310 may be supplied to the driving line DL, and when the driving control circuit 320 disconnects the driving current source 310 and the driving line DL, the supply of the driving current Ie to the driving line DL may be stopped.

The driving control circuit 320 may include a switch circuit SWp which controls the connection between the driving current source 310 and the driving line DL. The switch circuit SWp may connect or disconnect the driving current source 310 and the driving line DL depending on a PWM (pulse width modulation) signal. The PWM signal may have an ON period and an OFF period. In general, in the PWM signal, a period in which a voltage has a high level may be the ON period, and a period in which a voltage has a low level may be the OFF period. The switch circuit SWp may connect the driving current source 310 to the driving line DL during the ON period of the PWM signal, and may disconnect the driving current source 310 and the driving line DL during the OFF period of the PWM signal.

The sample and hold circuit 330 may sense a one-side voltage of the LEDs LED1 to LED3. One sides of the LEDs LED1 to LED3 may be connected to the driving line DL, and the sample and hold circuit 330 may sense the one-side voltage of the LEDs LED1 to LED3 through the driving line DL. One terminal To of the LED driving device 110 may be connected to the driving line DL, and the sample and hold circuit 330 may sense a voltage formed at the one terminal To. In the following description, a voltage Vt formed at the one terminal To is referred to as a terminal voltage. The terminal voltage Vt may correspond to a voltage of the driving line DL, and may correspond to the one-side voltage of the LEDs LED1 to LED3. The driving current Ie may be supplied to the driving line DL through the one terminal To.

The sample and hold circuit 330 may sense the one-side voltage of the LEDs LED1 to LED3, and may hold a voltage corresponding to a forward voltage among sensed voltages. The forward voltage may mean a voltage difference between both ends (an anode and a cathode) of each of the LEDs LED1 to LED3 when each of the LEDs LED1 to LED3 is normally conductive. The LED driving device 110 may determine that, when a voltage across each of the LEDs LED1 to LED3 reaches the forward voltage, each of the LEDs LED1 to LED3 normally emits light. In the case where the one-side voltage of each of the LEDs LED1 to LED3 sensed by the sample and hold circuit 330 is a voltage which is formed at the anode of each of the LEDs LED1 to LED3 and the cathode of each of the LEDs LED1 to LED3 is connected to a base voltage (for example, the ground), the one-side voltage of each of the LEDs LED1 to LED3 may be the same as the voltage across each of the LEDs LED1 to LED3.

The sample and hold circuit 330 may hold a voltage at a time point when it is determined that the one-side voltage of the LEDs LED1 to LED3 has reached a forward voltage. For example, when a predetermined time has elapsed after the driving current Ie is supplied to the LEDs LED1 to LED3, it may be determined that the LEDs LED1 to LED3 normally emit light. At this time point, the sample and hold circuit 330 may sample and hold the one-side voltage of the LEDs LED1 to LED3 as the forward voltage.

As an example, at a time point when the supply of the driving current Ie to the LEDs LED1 to LED3 is ended, the sample and hold circuit 330 may sample and hold the one-side voltage of the LEDs LED1 to LED3, and thereby, may sample and hold the forward voltage of the LEDs LED1 to LED3. The driving current Ie may be supplied to the LEDs LED1 to LED3 during the ON period of the PWM signal, and the sample and hold circuit 330 may sample and hold the forward voltage of the LEDs LED1 to LED3 at or near a falling edge of the PWM signal.

The sample and hold circuit 330 may measure a forward voltage reaching time by sensing the terminal voltage Vt (a voltage corresponding to the one-side voltage of the LEDs LED1 to LED3) during an early period of driving the LEDs LED1 to LED3, and may hold the forward voltage by sensing the terminal voltage Vt during a late period of driving the LEDs LED1 to LED3.

When the ON period of the PWM signal starts (for example, a rising edge of the PWM signal is checked), the sample and hold circuit 330 may sense the terminal voltage Vt and compare the terminal voltage Vt with a previously stored (previously held) forward voltage. The sample and hold circuit 330 may store a time for the terminal voltage Vt to reach the forward voltage. When such a time is referred to as the forward voltage reaching time, the LED driving device 110 may compensate a supply time of the driving current Ie by using the forward voltage reaching time.

At a time point when the ON period of the PWM signal ends (for example, a time point when a falling edge of the PWM signal is checked), the sample and hold circuit 330 may sense the terminal voltage Vt, and may store (hold) the terminal voltage Vt as the forward voltage. The held voltage may be used in driving a next scan line.

For the sake of convenience in explanation, hereinafter, a terminal voltage which is sensed during a K-th (K is a natural number of 2 or greater) scan time for driving a K-th scan line is symbolized as Vt[k].

The sample and hold circuit 330 may sense a terminal voltage Vt[k−1] according to the PWM signal during a (K−1)-th scan time, and may hold a voltage corresponding to a forward voltage. The held voltage may be symbolized as Vf[k−1]. A voltage to be held may be updated every scan time. The sample and hold circuit 330 may sense the terminal voltage Vt[k] according to the PWM signal during the K-th scan time, and may update a voltage corresponding to a forward voltage. The sample and hold circuit 330 may include a hold element (for example, a capacitor), and may hold and update a forward voltage in the hold element.

The sample and hold circuit 330 may sense the terminal voltage Vt[k] according to the PWM signal during the K-th scan time. The sample and hold circuit 330 may transfer the terminal voltage Vt[k], sensed during the K-th scan time, and the voltage Vf[k−1], held during the (K−1)-th scan time, to the PWM compensating circuit 340.

The PWM compensating circuit 340 may measure a forward voltage reaching time of an LED driven among the LEDs LED1 to LED3, and may increase a supply time of the driving current Ie by the forward voltage reaching time.

During a time period in which one LED is connected to the driving line DL, the PWM compensating circuit 340 may measure a time for a one-side voltage of the one LED to reach a voltage held for another one LED, as the forward voltage reaching time. For example, during a scan time of the second LED LED2, the PWM compensating circuit 340 may measure a time for a one-side voltage Vt[2] of the second LED LED2 to reach a voltage Vt[1] held for the first LED LED1, as a forward voltage reaching time of the second LED LED2.

The PWM compensating circuit 340 may store the forward voltage reaching time in one element (for example, a capacitor), and may compensate the PWM signal so that the ON period of the PWM signal is increased. The forward voltage reaching time may have little or no contribution to the luminance of the LEDs LED1 to LED3. Thus, the PWM compensating circuit 340 may increase a driving time of the LEDs LED1 to LED3 by increasing the ON period of the PWM signal by the forward voltage reaching time.

The PWM compensating circuit 340 may generate a secondary PWM signal SPb by compensating a primary PWM signal SPa transferred from the PWM generating circuit 350, and may transfer the secondary PWM signal SPb to the driving control circuit 320.

The PWM generating circuit 350 may generate the primary PWM signal SPa depending on a gray scale value included in image data. The image data may be received from an external device (for example, a host device, a timing controller, or the like), and a gray scale value indicating a luminance that each LED needs to display may be included in the image data. The PWM generating circuit 350 may generate the primary PWM signal SPa in conformity with the gray scale value. The PWM compensating circuit 340 may generate the secondary PWM signal SPb by compensating the primary PWM signal SPa.

Figure 4:
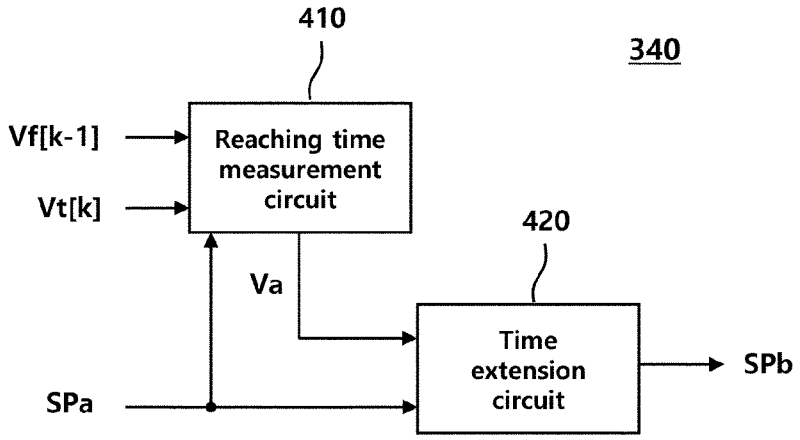
FIG. 4 is a configuration diagram of a PWM compensating circuit in accordance with an embodiment.

FIG. 4 is a configuration diagram of a PWM compensating circuit in accordance with an embodiment.

Referring to FIG. 4, the PWM compensating circuit 340 may include a reaching time measurement circuit 410 and a time extension circuit 420.

The reaching time measurement circuit 410 may receive a forward voltage held during another scan time (for example, the forward voltage Vf[k−1] held during the (K−1)-th scan time) and a terminal voltage sensed during the current scan time (for example, the terminal voltage Vt[k] sensed during the K-th scan time). The reaching time measurement circuit 410 may measure a time for the terminal voltage, sensed during the current scan time, to reach the forward voltage held during another scan time, while comparing the two voltages using the comparator. A starting time point of measurement may be a time point corresponding to a rising edge of the primary PWM signal SPa, and an ending time point of the measurement may be a time point when an output of the comparator is inverted.

The forward voltage reaching time may be stored as a voltage value Va. An example of the voltage value Va will be described later with reference to FIGS. 5 to 7.

The time extension circuit 420 may receive the voltage value Va corresponding to the forward voltage reaching time and the primary PWM signal SPa, and may generate the secondary PWM signal SPb by increasing the ON period of the primary PWM signal SPa depending on the forward voltage reaching time.

Figure 5:
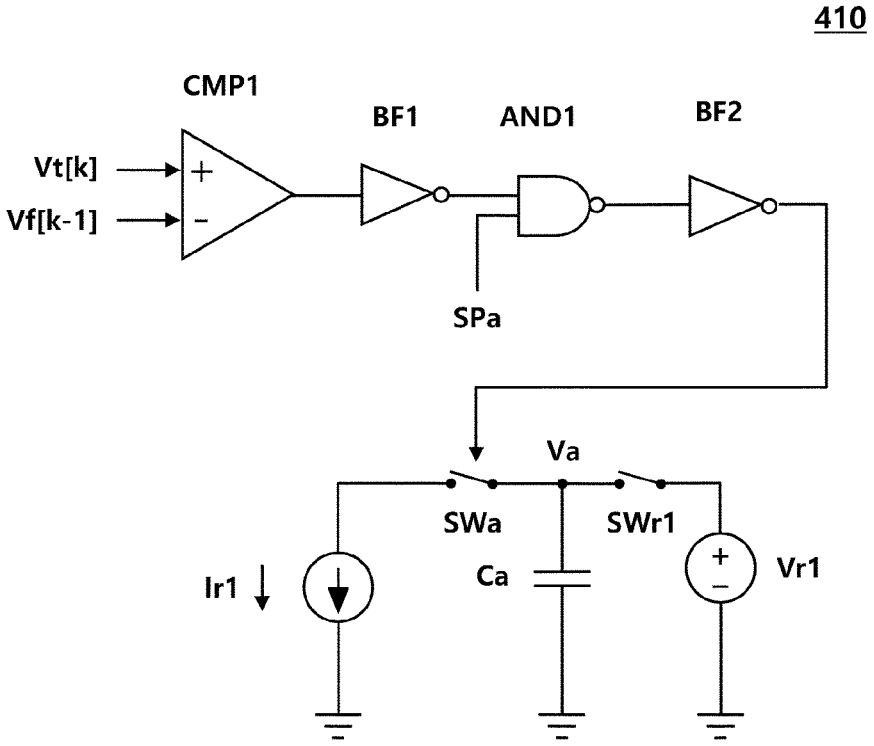
FIG. 5 is a configuration diagram of a reaching time measurement circuit in accordance with an embodiment.

FIG. 5 is a configuration diagram of a reaching time measurement circuit in accordance with an embodiment.

Referring to FIG. 5, the reaching time measurement circuit 410 may receive the terminal voltage Vt[k] being sensed during the K-th scan time (a current scan time) and the forward voltage Vf[k−1] sampled and held during the (K−1)-th scan time (a scan time of a previous scan line), and may input the two voltages to a first comparator CMP1. The reaching time measurement circuit 410 may input an output of the first comparator CMP1 to a first buffer BF1, and may input an inverted output of the first buffer BF1 to one terminal of a first AND circuit AND1. The reaching time measurement circuit 410 may input the primary PWM signal SPa to the other terminal of the first AND circuit AND1, may input an inverted output of the first AND circuit AND1 to a second buffer BF2, and may control the opening of a first charge/discharge switch SWa by using an inverted output of the second buffer BF2.

When the first charge/discharge switch SWa is closed, the charge charged in a first capacitor Ca is discharged at a constant rate by a first discharge current source Ir1, and when the first charge/discharge switch SWa is opened, the discharge of the first capacitor Ca is stopped. The first charge/discharge switch SWa may be closed from a rising edge of the primary PWM signal SPa to a time point when the terminal voltage Vt[k] becomes the same as the forward voltage Vf[k−1] through the first comparator CMP1. A voltage Va of the first capacitor Ca after the first charge/discharge switch SWa is opened may be the voltage value Va corresponding to the forward voltage reaching time.

An initial charge voltage of the first capacitor Ca may be determined by a first reference voltage Vr1, and the voltage of the first capacitor Ca may be reset to the first reference voltage Vr1 by a first reset switch SWr1.

Figure 6:
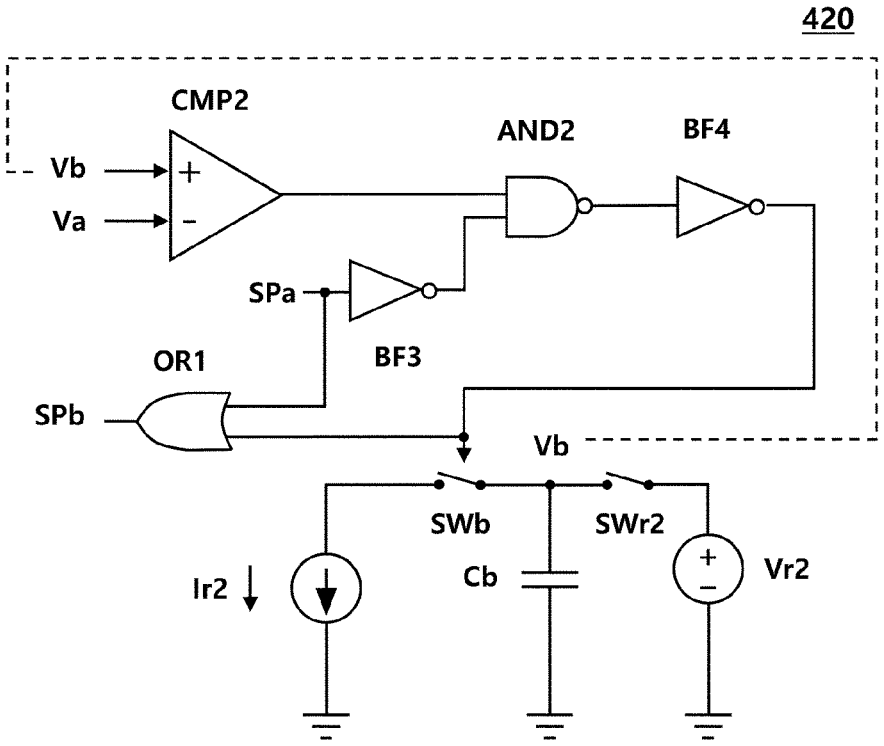
FIG. 6 is a configuration diagram of a time extension circuit in accordance with an embodiment.

FIG. 6 is a configuration diagram of a time extension circuit in accordance with an embodiment.

Referring to FIG. 6, the time extension circuit 420 may reset a second capacitor Cb to a second reference voltage Vr2, and may compensate the PWM signal by a time during which a voltage Vb of the second capacitor Cb becomes the same as the voltage Va of the first capacitor Ca while discharging the second capacitor Cb according to a second discharge current source Ir2.

In detail, the time extension circuit 420 may input the voltage Vb of the second capacitor Cb reset to the second reference voltage Vr2 and the voltage Va of the first capacitor Ca to a second comparator CMP2, and may input an output of the second comparator CMP2 to one terminal of a second AND circuit AND2. The time extension circuit 420 may invert the primary PWM signal SPa through a third buffer BF3, and may input an inverted signal of the third buffer BF3 to the other terminal of the second AND circuit AND2.

The time extension circuit 420 may input an inverted output of the second AND circuit AND2 to a fourth buffer BF4, and may control a second charge/discharge switch SWb depending on an inverted output of the fourth buffer BF4.

When the second charge/discharge switch SWb is closed, the charge charged in the second capacitor Cb is discharged at a constant rate by the second discharge current source Ir2, and when the second charge/discharge switch SWb is opened, the discharge of the second capacitor Cb is stopped. The second charge/discharge switch SWb may be closed from a falling edge of the primary PWM signal SPa to a time point when the second capacitor voltage Vb becomes the same as the first capacitor voltage Va through the second comparator CMP2.

An initial charge voltage of the second capacitor Cb may be determined by the second reference voltage Vr2, and the voltage of the second capacitor Cb may be reset to the second reference voltage Vr2 by a second reset switch SWr2.

Referring to FIGS. 5 and 6 together, the capacity of the first capacitor Ca and the capacity of the second capacitor Cb may be the same, and the magnitudes of the current discharged by the first discharge current source Ir1 and the current discharged by the second discharge current source Ir2 may be the same, and the voltage of the first reference voltage Vr1 and the voltage of the second reference voltage Vr2 may be the same. According to such setting, the forward voltage reaching time may be the same as the closing time of the second charge/discharge switch SWb.

The time extension circuit 420 may generate the secondary PWM signal SPb by ORing the primary PWM signal SPa and the control signal for the second charge/discharge switch SWb by an OR circuit OR1.

Figure 7:
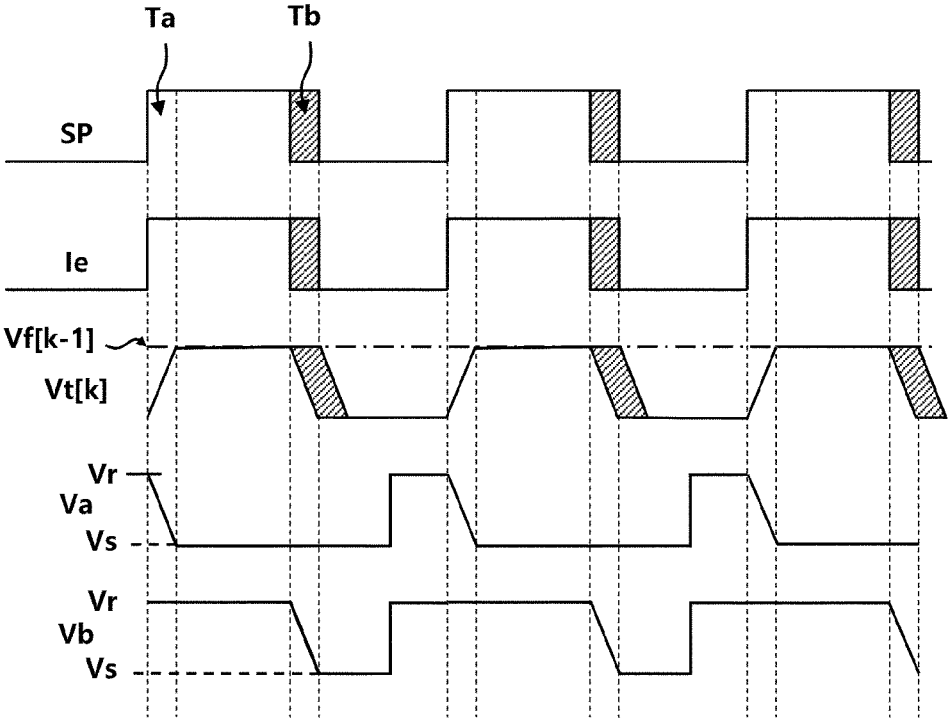
FIG. 7 is a diagram showing main waveforms of the circuits illustrated in FIGS. 5 and 6.

FIG. 7 is a diagram showing main waveforms of the circuits illustrated in FIGS. 5 and 6.

Referring to FIG. 7, the forward voltage Vf[k−1] maintains a constant level. Although a forward voltage Vf is updated during each scan time, the value of the forward voltage Vf may be maintained at the constant level when LEDs are placed under similar conditions. The forward voltage Vf may change with a certain tendency with the lapse of time.

During a time in which an LED is driven, the terminal voltage Vt[k] may rise from a rising edge of the PWM signal SP and may maintain a constant level after reaching the forward voltage. The terminal voltage Vt[k] may fall from a falling edge of the PWM signal SP.

The first capacitor voltage Va may be reset to a reference voltage Vr, and may start to fall from the rising edge of the PWM signal SP. The first capacitor voltage Va may stop falling at a time point when the terminal voltage Vt[k] becomes the same as the forward voltage Vf[k−1]. A time from the rising edge of the PWM signal SP to the time point when the terminal voltage Vt[k] becomes the same as the forward voltage Vf[k−1] may be a forward voltage reaching time Ta.

The second capacitor voltage Vb may be reset to the reference voltage Vr, and may start to fall from a falling edge of a primary PWM signal. The second capacitor voltage Vb may stop falling at a time point when the second capacitor voltage Vb becomes the same as the first capacitor voltage Va. A time from the falling edge of the primary PWM signal to the time point when the second capacitor voltage Vb becomes the same as the first capacitor voltage Va may be a compensation time Tb.

The PWM signal SP may be compensated into a state in which the ON period thereof is increased by the compensation time Tb.

Figure 8:
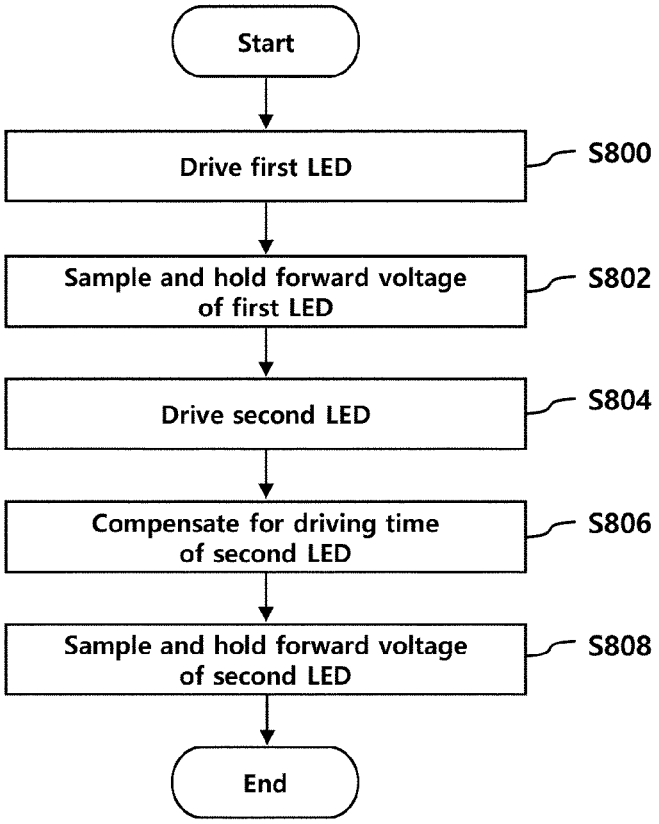
FIG. 8 is a flow chart of an LED driving method in accordance with an embodiment.

FIG. 8 is a flow chart of an LED driving method in accordance with an embodiment.

Referring to FIG. 8, an LED driving device may connect a first LED to a driving line according to a first scan signal. During a first scan time in which the first LED is connected to the driving line, the LED driving device (for example, a driving current source) may supply driving current to the first LED (S800). A supply time of the driving current to the first LED may be controlled by the LED driving device (for example, a driving control circuit).

During the first scan time, the LED driving device (for example, a sample and hold circuit) may sample and hold a forward voltage of the first LED (S802). The LED driving device may sense a one-side voltage of the first LED through the driving line, and may hold a voltage corresponding to the forward voltage among sensed voltages.

The LED driving device may connect a second LED to the driving line according to a second scan signal. During a second scan time in which the second LED is connected to the driving line, the LED driving device (for example, the driving current source) may supply the driving current to the second LED (S804). A supply time of the driving current to the second LED may be controlled by the LED driving device (for example, the driving control circuit).

When driving the second LED, the LED driving device (for example, the sample and hold circuit) may sense a one-side voltage of the second LED. The LED driving device (for example, a compensating circuit) may measure a time for the one-side voltage of the second LED to reach the voltage held for the first LED, and may compensate a supply time of the driving current to the second LED according to such a time (S806).

The LED driving device (for example, the sample am hold circuit) may input the voltage, held for the first LED, to one terminal of a comparator, and may connect the one-side voltage of the second LED to the other terminal of the comparator. The LED driving device (for example, the compensating circuit) may measure a forward voltage reaching time of the second LED depending on an output of the comparator. The LED driving device (for example, the compensating circuit) may compensate an ON period of a PWM signal, corresponding to the second LED, according to the forward voltage reaching time.

At the step S802, the LED driving device (for example, the sample and hold circuit) may hold the voltage, corresponding to the forward voltage of the first LED, in a hold element. The LED driving device (for example, the sample and hold circuit) may update the hold element with a voltage corresponding to a forward voltage of the second LED during the second scan time (S808). An update time point may be a time point corresponding to a falling edge of the PWM signal before compensation or the PWM signal after compensation during the second scan time.

The first LED may be an LED which is disposed on a previous scan line, and the second LED may be an LED which is disposed on a current scan line. The above process may be repeated for all scan lines. For example, after the step S808, the LED driving device may connect a third LED to the driving line according to a third scan signal, may supply the driving current to the third LED, and may measure a time for a one-side voltage of the third LED to reach the forward voltage of the second LED. The LED driving device may increase a supply time of the driving current to the third LED according to such a time.

As is apparent from the above description, according to the embodiments, it is possible to more accurately control a turn-on time of a PWM signal so that the brightness of an LED can match a gray scale value. Also, according to the embodiments, it is possible to compensate a PWM signal for a forward voltage reaching time of an LED so that no loss in a gray scale value is caused. Further, according to the embodiments, it is possible to simply measure a forward voltage reaching time of an LED without using a separate sequence. Moreover, according to the embodiments, it is possible to accurately measure a forward voltage reaching time of an LED, regardless of a change in characteristics of a panel, by continuously updating a forward voltage of the LED.

What is claimed is:

1. An LED driving device comprising:

a driving current source configured to supply a driving current to a driving line to which a plurality of LEDs are connected;

a driving control circuit configured to control a supply time of the driving current to the driving line according to a pulse width modulation (PWM) signal;

a sample and hold circuit configured to sense a one-side voltage of an LED and to hold a voltage corresponding to a forward voltage; and a PWM compensating circuit configured to, during a time period in which a second LED is connected to the driving line, measure a first time for a one-side voltage of the second LED to reach a voltage held regarding a first LED and to compensate for the PWM signal according to the first time, wherein a one-side of the LED is connected to the driving line and the sample and hold circuit senses the one-side voltage of the LED through the driving line.

2. The LED driving device of claim 1, wherein the driving control circuit comprises:

a switch circuit configured to control a connection between the driving current source and the driving line, wherein the switch circuit connects the driving current source and the driving line during an ON period of the PWM signal that is compensated for by the PWM compensating circuit.

3. The LED driving device of claim 1, further comprising a PWM generating circuit configured to generate a primary PWM signal depending on a gray scale value included in image data, wherein the PWM compensating circuit generates a secondary PWM signal by increasing an ON period of the primary PWM signal by the first time, and wherein the driving control circuit controls the supply time of the driving current according to an ON period of the secondary PWM signal.

4. The LED driving device of claim 3, wherein, at a time point when the supply time of the driving current to the second LED is ended, the voltage to be held is updated from a voltage for the first LED to a voltage for the second LED.

5. The LED driving device of claim 1, wherein the second LED is disposed on a scan line subsequent to that of the first LED.

6. The LED driving device of claim 1, wherein the one-side voltage corresponds to an anode voltage of the LED and a cathode of the LED is connected to a ground.

7. The LED driving device of claim 1, wherein the sample and hold circuit senses the one-side voltage of the LED by sensing a voltage formed on the driving line in every scan time.

8. An LED driving device comprising:

a driving current source configured to supply a driving current to a first LED during a first scan time and to supply the driving current to a second LED during a second scan time;

a sample and hold circuit configured to, during the first scan time, sense a one-side voltage of the first LED and to hold a voltage corresponding to a forward voltage; and a compensating circuit configured to, during the second scan time, measure a first time for a one-side voltage of the second LED to reach the voltage held regarding the first LED and to control a supply time of the driving current to the second LED according to the first time, wherein a one-side of the first LED or the second LED is connected to the driving line, and the sample and hold circuit senses the one-side voltage of the first LED or the second LED through the driving line.

9. The LED driving device of claim 8, further comprising:

a driving control circuit configured to control a supply time of the driving current according to a PWM (pulse width modulation) signal.

10. The LED driving device of claim 9, wherein the compensating circuit compensates for an ON period of the PWM signal corresponding to the second LED according to the first time.

11. The LED driving device of claim 8, wherein the sample and hold circuit holds a voltage corresponding to the forward voltage of the first LED in a hold element during the first scan time and updates the hold element with a voltage corresponding to a forward voltage of the second LED during the second scan time.

12. The LED driving device of claim 11, wherein the sample and hold circuit updates the hold element with the one-side voltage of the second LED sensed at a falling edge of the PWM signal before compensation or the PWM signal after compensation during the second scan time.

13. The LED driving device of claim 8, wherein the sample and hold circuit inputs the voltage, held regarding the first LED, to one terminal of a comparator and inputs the one-side voltage of the second LED to the other terminal of the comparator and the compensating circuit measures the first time depending on an output of the comparator.

14. A method for driving a plurality of LEDs disposed in a panel, the method comprising:

connecting a first LED to one driving line according to a first scan signal;

supplying a driving current, by a driving current source, to the first LED through the one driving line and sensing and holding a forward voltage of the first LED, by a sample and hold circuit;

connecting a second LED to the one driving line according to a second scan signal;

supplying the driving current, by the driving current source, to the second LED through the one driving line and measuring a first time for a one-side voltage of the second LED, by a compensating circuit, to reach the forward voltage of the first LED; and controlling a supply time of the driving current, by a driving control circuit, to the second LED according to the first time.

15. The method of claim 14, further comprising:

sensing and holding a forward voltage of the second LED, by the sample and hold circuit, when the driving current is supplied to the second LED through the one driving line;

connecting a third LED to the one driving line according to a third scan signal;

supplying the driving current, by the driving current source, to the third LED through the one driving line and measuring a second time for a one-side voltage of the third LED, by the compensating circuit, to reach the forward voltage of the second LED; and increasing a supply time of the driving current to the third LED according to the second time.

* * * * *